US007393049B2

(12) United States Patent
Chase

(10) Patent No.: US 7,393,049 B2
(45) Date of Patent: Jul. 1, 2008

(54) REPLACEABLE STOOL ASSEMBLY

(76) Inventor: John Chase, 1919 Vinsetta Ct., Rochester, MI (US) 48306

( * ) Notice: Subject to any disclaimer, the term of this patent is extended or adjusted under 35 U.S.C. 154(b) by 274 days.

(21) Appl. No.: 11/235,564

(22) Filed: Sep. 26, 2005

(65) Prior Publication Data

US 2006/0125294 A1 Jun. 15, 2006

Related U.S. Application Data

(60) Provisional application No. 60/630,677, filed on Nov. 23, 2004.

(51) Int. Cl.

| | |
|---|---|
| ***A47B 39/00*** | (2006.01) |
| ***A47B 83/02*** | (2006.01) |
| ***A47B 3/00*** | (2006.01) |
| ***A47C 4/02*** | (2006.01) |
| ***A47C 9/00*** | (2006.01) |

(52) U.S. Cl. ..... 297/134; 297/135; 297/156; 297/157.1; 297/159.1; 297/440.22; 297/461

(58) Field of Classification Search ..... 297/461, 297/440.22, 134, 135, 156, 157.1, 159.1
See application file for complete search history.

(56) References Cited

U.S. PATENT DOCUMENTS

| | | | | | |
|---|---|---|---|---|---|
| 669,497 | A | * | 3/1901 | Adler | 297/461 |
| 681,394 | A | | 8/1901 | Hile | |
| 713,639 | A | * | 11/1902 | Herbert | 297/461 |
| 2,646,840 | A | * | 7/1953 | Good | 297/461 X |
| D194,038 | S | | 11/1962 | Preston | D33/14 |
| 3,075,809 | A | | 1/1963 | Wilson | 297/159 |
| 3,109,678 | A | | 11/1963 | Wilson | 297/159 |
| 3,230,909 | A | * | 1/1966 | Watson | 297/461 X |
| 3,230,910 | A | * | 1/1966 | Olssen | 297/461 |
| D211,886 | S | | 8/1968 | Benjamin | D33/14 |
| 3,511,532 | A | | 5/1970 | Tringoli et al. | 297/159 |
| 3,715,143 | A | | 2/1973 | Gerken et al. | 297/159 |
| 3,770,319 | A | * | 11/1973 | Ono | 297/461 |
| D244,409 | S | | 5/1977 | Arnold | D6/45 |
| 4,092,042 | A | | 5/1978 | Cusenbary | 297/157 |
| D250,151 | S | | 11/1978 | Pingel | D6/45 |
| 4,208,072 | A | * | 6/1980 | Iskendarian | 297/440.22 X |
| D263,412 | S | | 3/1982 | Ament et al. | D21/242 |
| D266,037 | S | | 9/1982 | Heighberger | D6/26 |
| D268,971 | S | | 5/1983 | Reineman | D6/45 |
| D283,856 | S | | 5/1986 | Elmaleh | D6/349 |
| 4,998,774 | A | | 3/1991 | Huff et al. | 297/461 |
| 5,112,103 | A | * | 5/1992 | Downer | 297/461 X |
| 5,439,269 | A | * | 8/1995 | Cheng | 297/440.22 X |
| D413,734 | S | | 9/1999 | Bue | D6/337 |

(Continued)

FOREIGN PATENT DOCUMENTS

| | | | | | |
|---|---|---|---|---|---|
| GB | 2154868 | A | * | 9/1985 | 297/440.22 |

*Primary Examiner*—Rodney B. White
(74) *Attorney, Agent, or Firm*—Bliss McGlynn, P.C.

(57) ABSTRACT

A replaceable stool assembly is adapted to be removably mounted to the free end of a tubing of a piece of furniture. The assembly includes a base portion adapted to be removably mounted to the free end of the tubing and defining a plurality of reinforcing ribs disposed on the base portion for adding structural integrity to the base portion. The stool assembly further includes a seat portion adapted to operatively support a user of the assembly and be nestingly received by and removably supported on the base portion.

15 Claims, 3 Drawing Sheets

U.S. PATENT DOCUMENTS

| | | | | |
|---|---|---|---|---|
| 6,065,802 | A | 5/2000 | Bue | 297/158.4 |
| 6,186,591 | B1 | 2/2001 | Pajerski | 297/159.1 |
| D439,060 | S | 3/2001 | Larsen | D6/337 |
| 6,254,178 | B1 | 7/2001 | Bue | 297/159.1 |
| D456,155 | S | 4/2002 | DeVriendt | D6/337 |
| 6,386,628 | B2 | 5/2002 | Bue | 297/158.3 |
| D478,732 | S | 8/2003 | Pajerski et al. | D6/337 |
| D479,406 | S | 9/2003 | Pajerski et al. | D6/337 |
| D479,773 | S | 9/2003 | Pajerski et al. | D6/337 |
| 6,749,265 | B1 * | 6/2004 | Wang | 297/440.22 X |
| 7,234,780 | B2 * | 6/2007 | Lipniarski | 297/461 |

* cited by examiner

FIG - 1
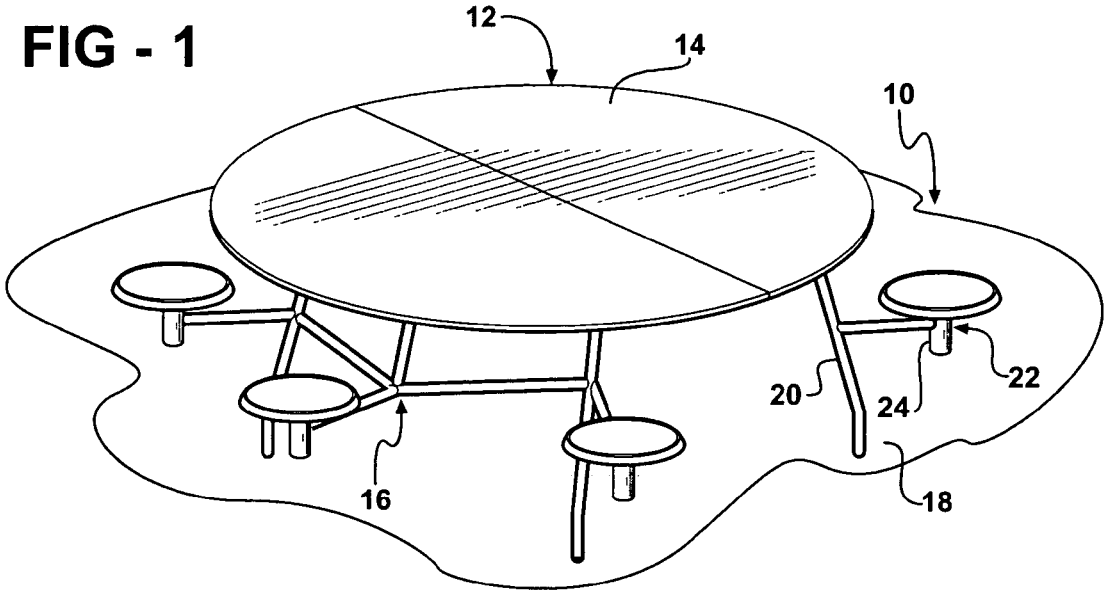
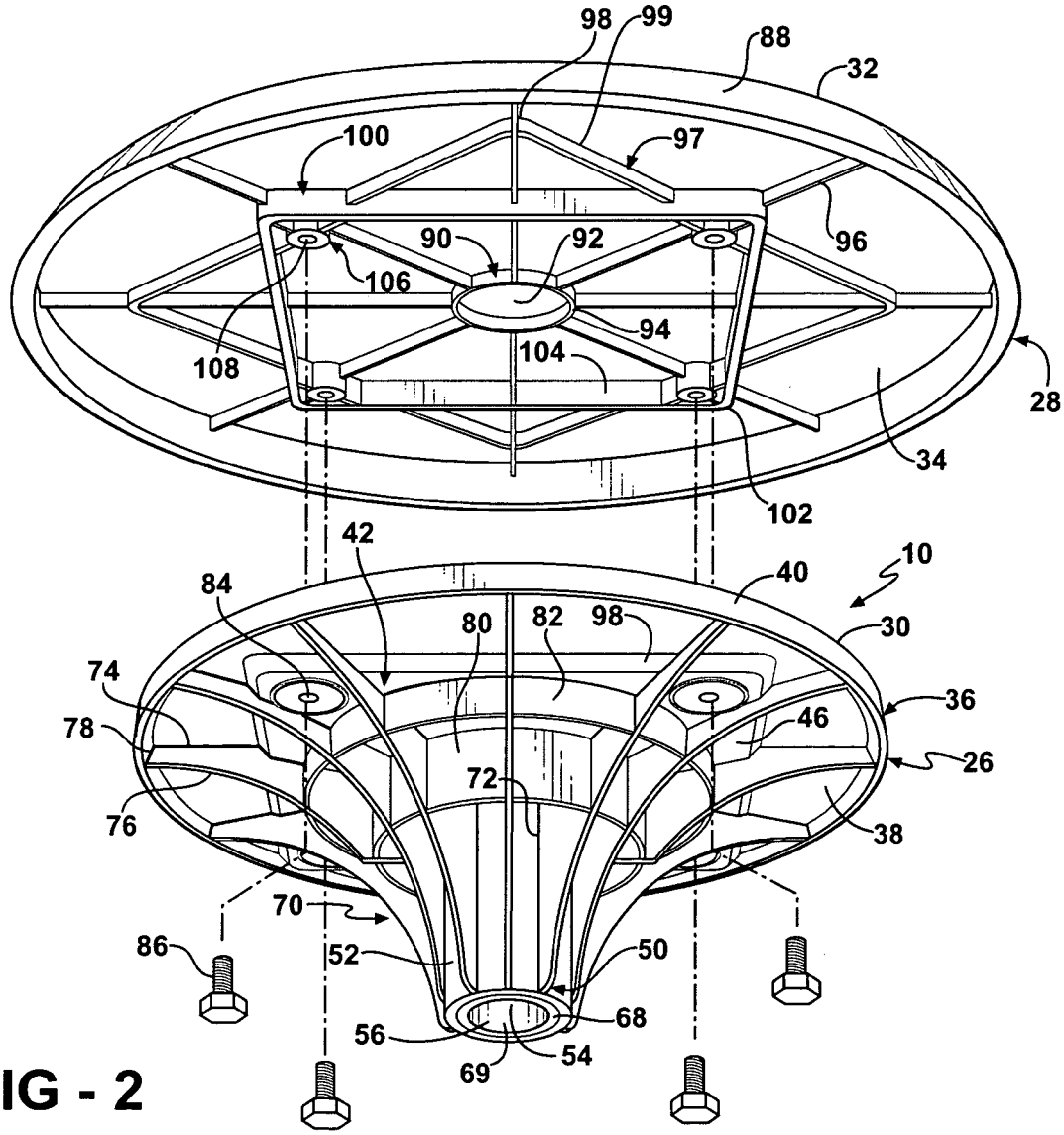
FIG - 2

REPLACEABLE STOOL ASSEMBLY

This application claims the benefit of U.S. Provisional Patent Application 60/630,677 filed Nov. 23, 2004 and entitled "Replaceable Stool Assembly."

BACKGROUND OF THE INVENTION

1. Field of the Invention

The present invention relates generally to a stool and, in particular, to a table stool assembly adapted to be replaceable by parts of the assembly.

2. Description of the Related Art

It is known to provide tables having a plurality of stools that are adapted to accommodate a number of people. Tables of this type are often employed in assembly areas, such as cafeterias like those commonly found in many institutionalized settings. These tables may be rollingly movable along a floor, stand alone or be connected to one another, be foldable, and/or simply be supported upon the floor. Alternatively, they may even fold out from any of the walls of the room to be supported upon the floor.

More specifically, tables of this type are typically designed to include a plurality of stools disposed about the perimeter of the table. In this regard, the table may include a metal framework that supports a tabletop as well as a plurality of stools. The framework acts to connect adjacent and/or opposed stools about the perimeter of the tabletop. The framework also includes a plurality of legs for supporting corresponding stools and the tabletop above the floor. Furthermore, each stool-supporting leg generally includes a hollow or solid tubing to which the seating portion of the stool is supported and that can form a part of the stool. The tubing often has a 1" or 1¼" diameter, and at least a portion of the tubing extends perpendicular to the floor and tabletop. The end of each leg operatively contacting the floor may include a cap, foot, or glide or even a caster for rollingly moving the table.

One type of table-stool seating portion commonly employed in the related art is an integral, one-piece unit that includes an upper seat portion that supports a person sitting on the stool and a lower seat-support structure. In turn, the seat-support structure is supported upon the tubing that forms a portion of the metal framework. The seat-support structure is designed to support the weight of any person using the seat portion. Accordingly, the seat-support structure often makes up a majority of the mass and volume of the stool seating portion as well as the cost for materials used to manufacture the stool seating portion. Stool seating portions of this type can be manufactured from plastic and are commonly supplied in a variety of colors.

However, it is not uncommon for a stool seating portion to wear out over time after repeated use. For example, sometimes the seat portion eventually fails in some manner, such as by cracking, deforming, fading, or otherwise deteriorating. On the other hand, sometimes the seat-support structure eventually fails in some manner, such as by cracking, deforming, snapping, or otherwise deteriorating. Sometimes both the seat portion and seat-support structure eventually fail. In any event, whenever replacement of the seat-support structure for tubing accommodation is necessary, the integral, one-piece stool seating portion is detached from the tubing, and a new integral, one-piece stool seating portion having the appropriate color is mounted to the tubing. Whether it is the seat portion, the seat-support structure, or both that fail(s), the entire stool seating portion must be replaced. Furthermore, because the tubing used in these applications has at least two sizes, two different sizes of a replacement seat-support structure must be manufactured to accommodate the diameter of the tubing.

In this regard, when the stool seating portion is made of plastic having a particular color, it is often desirable to match the new stool-seating-portion color with the color of the existing stool seating portions used on any given table. This means that manufacturers and wholesalers of this type of stool seating portion must maintain an inventory of the stool seating portions in each color. In turn, this raises the cost of doing business for both the manufacturers and wholesalers. Also, because the bulk of the mass and volume of the stool seating portion is in the seat-support structure, the cost of replacing a stool seating portion having a particular color when only the seat portion needs replacing is inefficient. In an institutionalized setting, this can be especially labor- and material-intensive and, thus, expensive, which is especially relatively inefficient.

Another type of table-stool seating system commonly employed in the related art is a two-piece unit. More specifically, the stool seating system generally includes an upper seat portion that supports a person sitting on the stool. The stool further includes a square plate removably attachable to the bottom surface of the upper seat portion using a special array of fasteners.

However, this type of table-stool seating portion suffers from the disadvantage that the seat portion can be replaced only by a seat portion including a bottom surface having holes adapted to accept the special array of fasteners used to mount it to the plate. This type of table-stool seating portion also suffers from the disadvantage that it is not compatible with the integral, one-piece stool seating portion as described above. As such, a mismatch of one-piece and two-piece stool seating portions for a particular table can result. Such a mismatch can be aesthetically displeasing.

Thus, there is a need in the related art for an aftermarket replacement table-stool seating portion. More specifically, there is a need in the related art for a relatively less labor- and material-intensive and, thus, less expensive way of replacing a stool seating portion supported by tubing of a table such that replacement of any part of the stool seating portion does not necessarily require replacement of the entire stool seating portion.

SUMMARY OF THE INVENTION

The present invention overcomes the disadvantages in the related art in a replaceable stool assembly adapted to be mounted to the free end of a tubing of a piece of furniture. The assembly includes a base portion adapted to be removably mounted to the free end of the tubing and defining a plurality of reinforcing ribs disposed on the base portion for adding structural integrity to the base portion. The stool assembly further includes a seat portion adapted to operatively support a user of the assembly and be nestingly received by and removably supported on the base portion.

The replaceable stool assembly of the present invention is an aftermarket table-stool seating portion that is relatively easily and efficiently employed. More specifically, the assembly requires relatively less labor and fewer materials and, thus, expense in operation, and replacement of any part of the assembly does not necessarily require replacement of the entire assembly. For example, when either the base portion or seat portion is damaged, only the respective damaged base portion or seat portion must be replaced. In a like manner, when a change in color of the seat portion is desired, only the seat portion must be replaced. Also, the assembly fits most tables with either 1" or 1¼" diameter tubing and bolts into existing holes of the tubing such that no re-drilling is required. Furthermore, the assembly can replace known one-piece or two-piece table-stool seating portions. In addition, the assembly is made of a relatively stronger ABS plastic. Moreover, the seat and base portions can be used to accommodate tubing of various sizes.

Other objects, features, and advantages of the present invention will be readily appreciated as the same becomes better understood after reading the subsequent description taken in conjunction with the accompanying drawings.

BRIEF DESCRIPTION OF THE DRAWINGS

FIG. 1 is an environmental view of a table showing a replaceable stool assembly of the present invention removably mounted to the free end of each tubing of the table;

FIG. 2 is an exploded perspective assembly view of the replaceable stool assembly of the present invention;

DETAILED DESCRIPTION OF AN EMBODIMENT OF THE INVENTION

Figure 3:
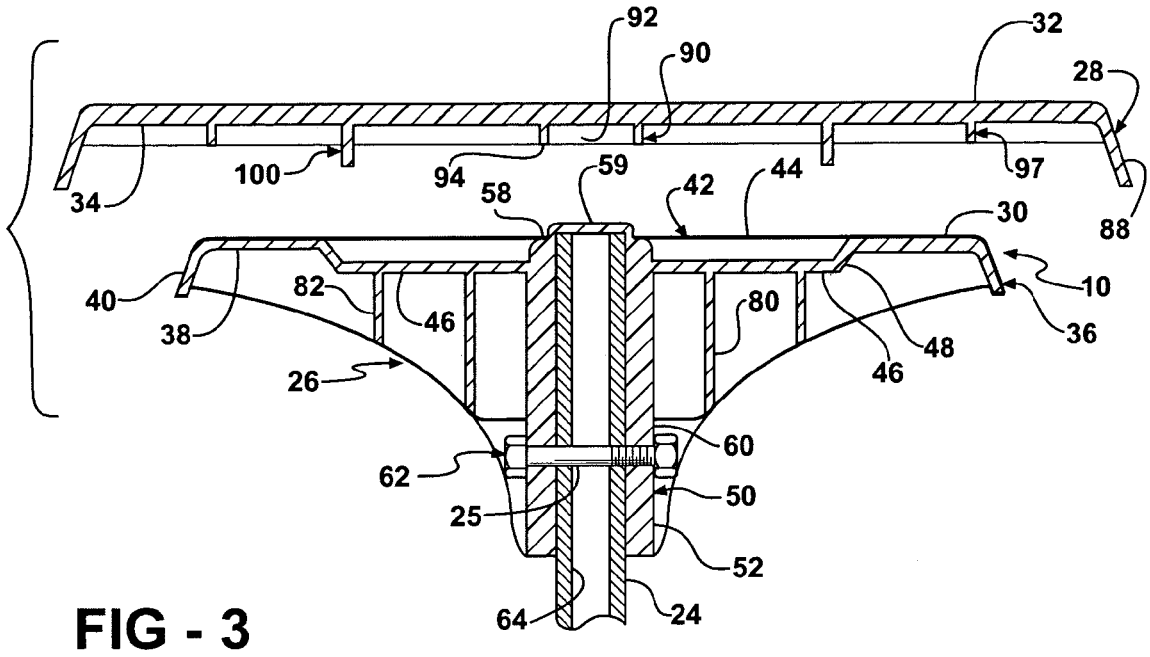
FIG. 3 is an exploded cross-sectional side view of the replaceable stool assembly of the present invention.
Figure 4:
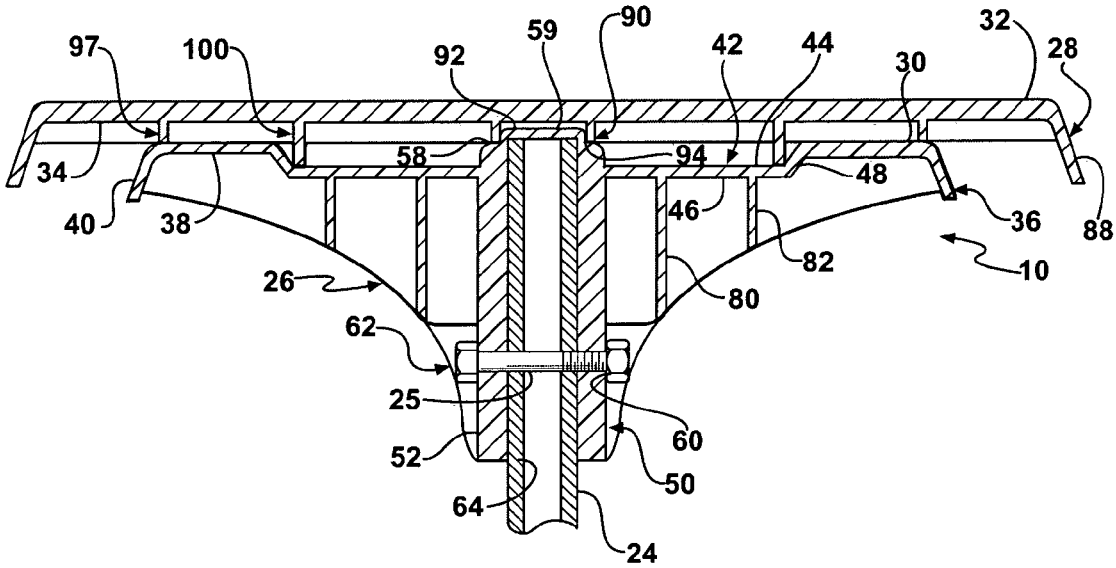
FIG. 4 is a cross-sectional side view of the replaceable stool assembly of the present invention.
Figure 5:
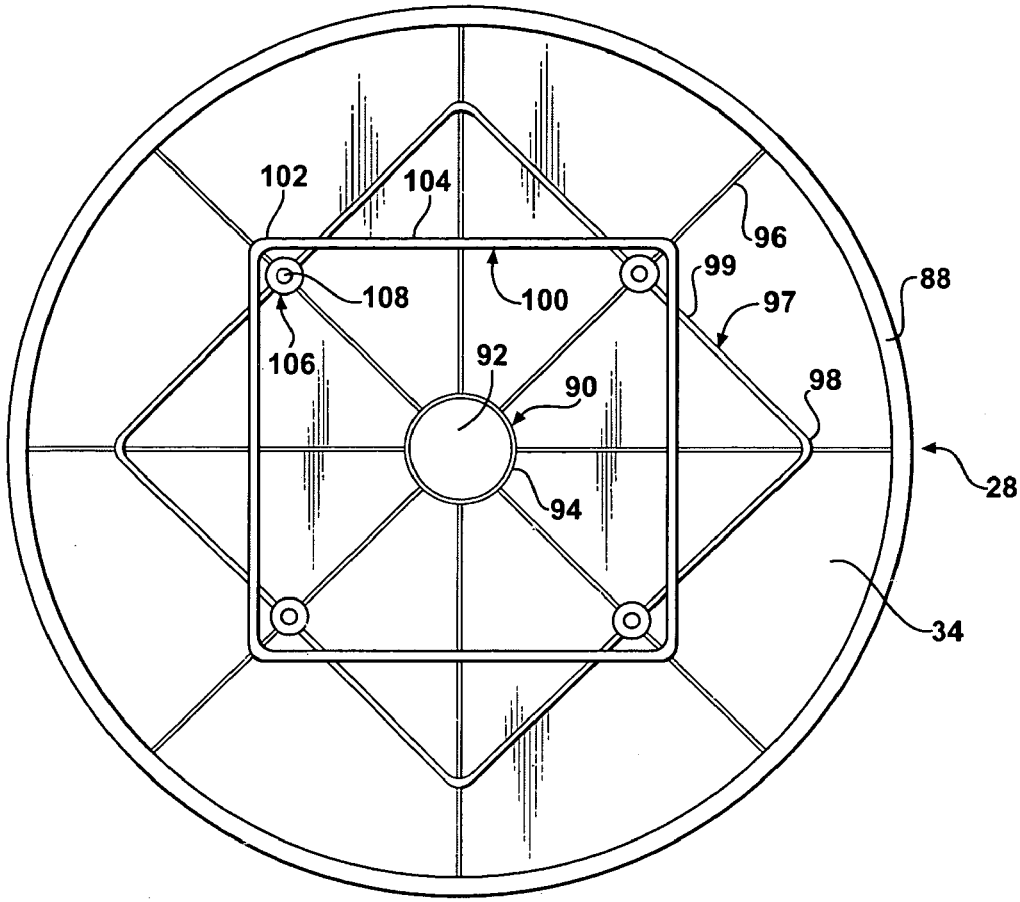
FIG. 5 is a bottom view of the seat portion of the replaceable stool assembly of the present invention.

Referring now to the figures, where like numerals are used to designate like structure, a replaceable stool assembly of the present invention is generally indicated at 10 in FIGS. 1 through 4. As shown in FIG. 1, a piece of furniture—particularly, a table—generally indicated at 12, may include a plurality of stool assemblies 10 disposed partially about the perimeter of the table 12. In this regard, the table 12 may include a tabletop 14 and a framework, generally indicated at 16, attached to the tabletop 14 and operatively disposed between the tabletop 14 and a surface upon which the table 12 is supported, such as a floor 18. The framework 16 acts to connect adjacent stool assemblies 10 to each other and each assembly 10 to the tabletop 14. The framework 16 also includes a plurality of tabletop-supporting legs 20 extending from the floor 18 to the underside of the tabletop 14 for supporting the tabletop 14 above the floor 18. Similarly, a plurality of assembly-supporting legs, generally indicated at 22, extend from the floor 18 to the underside of corresponding stool assemblies 10 for supporting the corresponding assemblies 10 above the floor 18.

The stool assembly 10 is described below and shown in FIG. 1 used in connection with a table 12. However, those having ordinary skill in the related art will appreciate that the stool assembly 10 can be used in connection with any suitable piece of furniture, such as a counter. Although the tabletop 14 shown in FIG. 1 is substantially round and foldable and the table 12 is stand-alone, it will also be appreciated that the table 12, in general, and each of the components of the table 12, in particular, can have any suitable shape, size, and structure and the table 12 can have any suitable structural relationship with respect to any other tables. Similarly, each of the components of the table 12 can have any suitable structural relationship with respect to each other and be made of any suitable material. It will also be appreciated that the stool assembly 10 can find special application when used in connection with tables often found in an institutionalized setting, such as a school, cafeteria, assembly area, or the like.

Still referring to FIG. 1, each assembly-supporting leg 22 includes a substantially hollow or solid, uniformly shaped tubing 24 extending in a direction from the floor 18 to the tabletop 14 and substantially perpendicular to them. The tubing 24 is substantially cylindrical and narrow relative to the maximum diameter of the stool assembly 10. Typically, the tubing 24 has a diameter of substantially 1" or 1¼". The tubing 24 also defines a pair of opposed, transverse holes 25, shown in FIGS. 3 and 4, adapted to receive a fastener for removably fastening the stool assembly 10 about the free end of the tubing 24, as described in detail below. The free end of the tubing 24 may be closed or opened. It will be appreciated by those having ordinary skill in the related art that the tubing 24 can have any suitable shape and size and structural relationship with respect to the floor 18 and stool assembly 10. More specifically, the tubing 24 can have any suitably sized diameter.

In general, the stool assembly 10 is adapted to be removably mounted to the free end of the tubing 24. To this end and as shown in FIGS. 2 through 6, the stool assembly 10 includes a base portion, generally indicated at 26, adapted to be removably mounted to the free end of the tubing 24 and defining a plurality of reinforcing ribs, generally indicated at 70, disposed on the base portion 26 for adding structural integrity to the base portion 26. The stool assembly 10 further includes a seat portion, generally indicated at 28, adapted to operatively support a user of the stool assembly 10 and be nestingly received by and removably supported on the base portion 26.

In an embodiment of the stool assembly 10 shown in the figures, the base portion 26 has a top surface 30, and the seat portion 28 has a top surface 32 and a bottom surface 34. The top surface 32 of the seat portion 28 is adapted to operatively support a user of the stool assembly 10, and the bottom surface 34 of the seat portion 28 is adapted to be nestingly received by and removably supported on the top surface 30 of the base portion 26.

As shown in FIGS. 2 through 4 and 6, the base portion 26 is somewhat conical in shape. The base portion 26 includes a body portion, generally indicated at 36, having the substantially planar top surface 30 and a substantially planar bottom surface 38. The body portion 36 also defines a substantially uniform rim 40 disposed completely about the bottom surface 38. The rim 40 defines an angle greater than 90° with respect to the bottom surface 38. Also, an arcuate or a linear corner can be defined between the rim 40 and the top surface 30 and between the rim 40 and the bottom surface 38.

As described below, the bottom surface 34 of the seat portion 28 includes at least one projection, generally indicated at 100, and the top surface 30 of the base portion 26 includes at least one cavity, generally indicated at 42, adapted to nestingly receive each corresponding projection 100 such that the bottom surface 34 of the seat portion 28 is removably supported on the top surface 30 of the base portion 26.

To this end and in the embodiment shown, the top surface 30 of the body portion 36 defines a relatively shallow, substantially square sunken portion 42. The sunken portion 42 is disposed substantially concentrically and symmetrically with respect to the top surface 30 of the body portion 36. The sunken portion 42 includes a substantially planar upper surface 44 and lower surface 46. The sunken portion 42 also defines a substantially uniform rim 48 of the upper surface 44. The rim 48 defines an angle greater than 90° with respect to the upper surface 44 of the sunken portion 42. Also, an arcuate or a linear corner can be defined between the rim 48 and the upper surface 44 of the sunken portion 42 and between the rim 48 and the top surface 30 of the body portion 36. Similarly, an arcuate or linear corner can be defined between the rim 48 and the lower surface 46 of the sunken portion 42 and between the rim 48 and the bottom surface 38 of the body portion 36.

The base portion 26 also includes a stem portion, generally indicated at 50, extending integrally and substantially perpendicularly from a substantially central area of the lower surface 46 of the sunken portion 42. The stem portion 50 is substantially uniform and cylindrical to define a diameter of the stem portion 50. The stem portion 50 also defines an exterior surface 52 and a longitudinal passageway 54 extending through the substantially central axis of the stem portion 50 to define a hollow interior 54 and an opened end 56 of the stem portion 50. The free end of the tubing 24 is adapted to be matingly received through the opened end 56 and within the hollow interior 54 of the stem portion 50 (or an insert, which is described below) to removably mount the base portion 26 about the free end of the tubing 24.

As described below, the bottom surface 34 of the seat portion 28 includes at least one protrusion 90 defining a substantially hollow interior 91 and an opened end 92 of the protrusion 90. The top surface 30 of the base portion 26 defines at least one protrusion 59 adapted to be matingly received through the opened end 92 and within the hollow interior 91 of each corresponding protrusion 90 of the seat portion 28 such that the bottom surface 34 of the seat portion 28 is removably supported on the top surface 30 of the base portion 26. To this end and in the embodiment shown, the other end of the stem portion 50 protrudes through the sunken portion 42 to define a shoulder 58 and the protrusion, or a neck 59, disposed above the upper surface 44 of the sunken portion 42.

The base portion 26 is adapted to receive a fastener, generally indicated at 62, for removably fastening the base portion 26 to the free end of the tubing 24. To this end, the stem portion 50 also defines a pair of opposed, transverse apertures 60 adapted to be aligned with the holes 25 of the tubing 25 and receive a fastener, such as a combination of a nylon lock-nut and bolt 62, for removably fastening the base portion 26 about the free end of the tubing 24. Also, the hollow interior 54 of the stem portion 50 defines an interior surface 64 of the stem portion 50. The interior surface 64 is adapted to be in operative contact with the free end of the tubing 24 (or the insert) and can be substantially smooth.

The interior surface 64 can also define a plurality of substantially uniform, linear ribs extending along the interior surface 64 from the opened end 56 of the stem portion 50 to the lower surface 46 of the sunken portion 42. The ribs are adapted to strengthen the interference fit between the stem portion 50 and the free end of the tubing 24. In such case, the ribs are substantially parallel and equidistantly spaced with respect to each other and substantially parallel with respect to the central axis of the stem portion 50.

Figure 6:
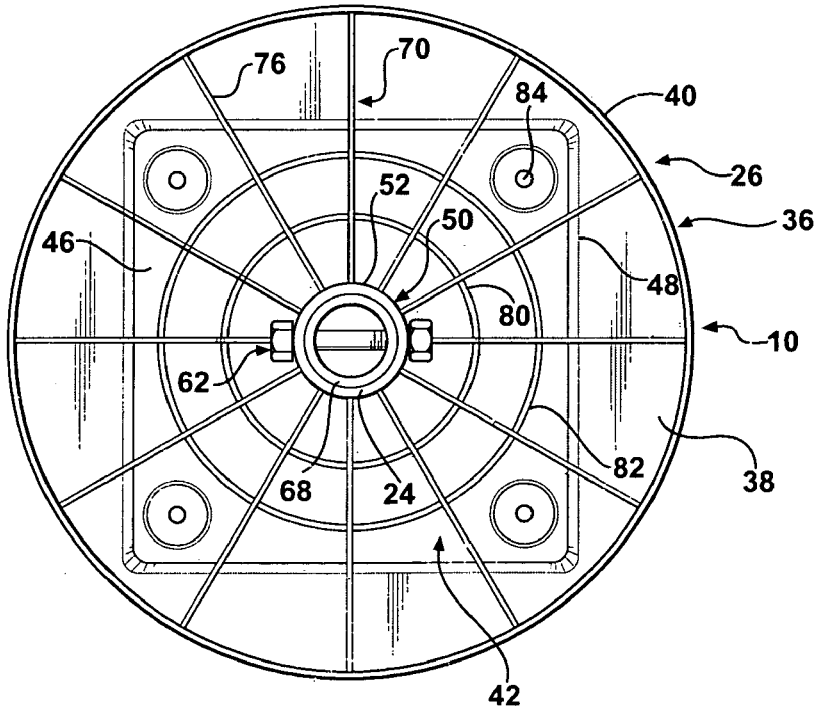
FIG. 6 is a bottom view of the base portion of the replaceable stool assembly of the present invention.

In the case in which the tubing 24 has a substantially 1" diameter, for example, the stool assembly 10 further includes an insert 68, as shown in FIGS. 2 and 6, adapted to be removably mounted to the free end of the base portion 26 and the free end of the tubing 24 to, thereby, removably mount the base portion 26 to the free end of the tubing 24. More specifically, the insert 68 is adapted to be matingly received through the opened end 56 and within the hollow interior 54 of the stem portion 50 so as to be in substantially flush operative contact with the interior surface 64 of the stem portion 50.

To this end, the insert 68 is substantially uniform and cylindrical to define a diameter of the insert 68 that is smaller than the diameter of the stem portion 50. The insert 68 also defines an exterior surface (not shown) and the longitudinal passageway 54 extending completely through the substantially central axis of the insert 68 to define the hollow interior 54 and the opened end 56 of the insert 68. The exterior surface of the insert 68 is adapted to be in operative contact with the interior surface 64 of the stem portion 50 and can be substantially smooth. In this way, the stem portion 50 is adapted to receive the insert 68 to create a slight, yet snug, interference fit between the stem portion 50 and insert 68 to removably mount the base portion 26 to the insert 68.

The free end of the tubing 24 is adapted to be matingly received through the opened end 56 and within the hollow interior 54 of the insert 68 to removably mount the insert 68 to the free end of the tubing 24 and, thereby, the base portion 26 to the free end of the tubing 24. More specifically, the hollow interior 54 of the insert 68 defines an interior surface 69 of the insert 68. The interior surface 69 is adapted to be in operative contact with the exterior surface of the free end of the tubing 24 and can be substantially smooth. In this way, the insert 68 is adapted to receive the free end of the tubing 24 to create a slight, yet snug, interference fit between the insert 68 and the free end of the tubing 24 to removably mount the base portion 26 about the free end of the tubing 24. The other end of the insert 68 is adapted to operatively abut the lower surface 36 of the sunken portion 32.

The insert 68 is adapted to receive the combination of the lock-nut and bolt 62 for removably fastening the base portion 26 to the free end of the tubing 24. More specifically, the insert 68 also defines a pair of opposed, transverse apertures (not shown) adapted to be aligned with the apertures 60 of the stem portion 50 and receive the combination of the lock-nut and bolt 62 for removably fastening the base portion 26 about the free end of the tubing 24.

The interior surface 69 (and/or exterior surface) of the insert 68 can also define a plurality of substantially uniform, linear ribs extending along the interior surface 69 (and/or exterior surface) from the opened end 56 of the insert 68 to the other end of the insert 68. The ribs are adapted to strengthen the interference fit between the insert 68 and the free end of the tubing 24 (and/or the stem portion 50). In such case, the ribs are substantially parallel and equidistantly spaced with respect to each other and substantially parallel with respect to the central axis of the insert 68.

Alternatively, in the case in which the tubing 24 has a substantially 1¼" diameter, for example, the insert 68 can be removed, and the tubing 24 only can be matingly received through the opened end 56 and within the hollow interior 54 of the stem portion 50 so as to be in operative contact with the interior surface 64 of the stem portion 50. In this way, a slight, yet snug, interference fit between the stem portion 50 and the free end of the tubing 24 is created to removably mount the base portion 26 about the free end of the tubing 24.

Those having ordinary skill in the related art will appreciate that in the operative state of the stool assembly 10, the top surface 30 of the base portion 26 is substantially concentric with the bottom surface 34 of the seat portion 28, which is described in detail below.

Some of the reinforcing ribs 70 of the base portion 26 are disposed about the stem portion 50 for adding structural integrity to the base portion 26. In particular, these ribs 70 are substantially right-triangular and disposed substantially equidistantly spaced with respect to each other and completely about the stem portion 50. More specifically and in the embodiment shown, these ribs are cornices 70. A leg 72 of each cornice 70 extends integrally along the exterior surface 52 of the stem portion 50 continuously from the free end of the stem portion 50 to the lower surface 46 of the sunken portion 42. The other leg 74 of the cornice 70 integrally extends along the lower surface 46 of the sunken portion 42 and the bottom surface 38 of the body portion 36 continuously from the stem portion 50 to the rim 40 of the body portion 36. A substantial portion of the hypotenuse 76 of the cornice 70 is concave with respect to the exterior of the stool assembly 10 such that the base portion 26 appears to be conical and flare from the free end of the stem portion 50 to the rim 40 of the body portion 36. However, the end of the hypotenuse 76 disposed proximate the free end of the stem portion 50 is convex with respect to the exterior of the stool assembly 10. Also, a surface 78 of the cornice 70 is defined between the hypotenuse 76 and the leg 74 and integrally abuts the rim 40 of the body portion 36.

Furthermore, some of the reinforcing ribs 70 of the base portion 26 are disposed on the bottom surface 38 of the body portion 38 for adding structural integrity to the base portion 26. In particular, the base portion 26 defines at least one ring 70 extending from the body portion 36 toward the free end of the stem portion 50 and disposed about the stem portion 50. More specifically, a substantially uniform inner ring 80 extends integrally from the lower surface 46 of the sunken portion 42 toward the free end of the stem portion 50 and is disposed substantially concentrically about the stem portion 50. An outer ring 82 also extends integrally from the lower surface 46 of the sunken portion 42 toward the free end of the stem portion 50 and is disposed substantially concentrically about the inner ring 80. In this way, the inner and outer rings 80, 82, respectively, are disposed substantially parallel with respect to each other and symmetrical with respect to the lower surface 46 of the sunken portion 42. The inner ring 80 extends farther than the outer ring 82, and each ring 80, 82 intersects and is interleaved with respect to the cornices 70. In particular, the bottom of each ring 80, 82 intersects substantially flush the corresponding hypotenuses 76. The distance between the exterior surface 52 of the stem portion 50 and inner ring 80 is substantially equal to the distance between the inner and outer rings 80, 82, respectively, which is less than the distance between the outer ring 82 and the rim 40 of the body portion 36. Like the cornices 70, the rings 80, 82 are adapted to add structural integrity to the base portion 26.

Moreover, the base and seat portions 26, 28, respectively, are adapted to receive at least one fastener 86 for removably fastening the base and seat portions 26, 28, respectively, together. To this end, each corner of the lower surface 46 of the sunken portion 42 defines a hole 84 extending through the depth of the body portion 36 and between adjacent cornices 70 such that non-diagonal adjacent holes 84 are approximately five inches apart. Each hole 84 is adapted to receive a fastener, such as a bolt or screw 86, for removably fastening the seat portion 28 to the base portion 26.

As shown in FIGS. 2 through 5, the seat portion 28 is substantially circular and defines a substantially uniform rim 88 disposed completely about the bottom surface 34 of the seat portion 28. The rim 88 defines an angle greater than 90° with respect to the bottom surface 34. Each of the top surface 32 and bottom surface 34 of the seat portion 28 is substantially planar. The bottom surface 34 and the interior surface of the rim 88 are substantially smooth, and the top surface 32 and the exterior surface of the rim 88 can be substantially non-smooth for adding friction to better operatively support a user of the stool assembly 10.

In the embodiment shown, the protrusion 90 of the bottom surface 34 of the seat portion 28 is a substantially uniform ring 90 extending integrally downward from the bottom surface 34 and disposed substantially concentric with the bottom surface 34. The ring 90 defines a substantially hollow interior 91 and an opened end 92 of the ring 90. The neck 59 of the stem portion 50 is adapted to be matingly received through the opened end 92 and within the hollow interior 92 of the ring 90 such that the bottom surface 34 of the seat portion 28 is removably supported on the top surface 30 of the base portion 26. In this way, the seat portion 28 can be operatively supported in substantial alignment with respect to the base portion 26 such that the bottom edge 94 of the ring 90 abuts the shoulder 58 of the stem portion 50.

The seat portion 28 also includes a plurality of substantially straight, uniform ribs 96 extending integrally downward from and along the bottom surface 34 from the ring 90 to the rim 88 such that the ribs 96 abut the ring 90 and rim 88. The ribs 96 also are disposed substantially flush with the ring 90 and symmetrically about the ring 90 such that the amount of space between adjacent ribs 96 is substantially equal. The ribs 96 are adapted to add structural integrity to the seat portion 28.

The seat portion 28 also includes a substantially uniform square enclosure, generally indicated at 97, extending integrally downward from the bottom surface 34 and disposed substantially concentric with the bottom surface 34. The enclosure 97 encloses the ring 90 and is inwardly spaced from the rim 88. The vertices 98 of the enclosure 97 intersect and are interleaved with respect to corresponding alternating ribs 96, and the segments 99 of the enclosure 97 intersect and are interleaved with respect to the corresponding other alternating ribs 96. The enclosure 97 also is disposed substantially flush with the ribs 96 and adapted to add structural integrity to the seat portion 28 as well.

In the embodiment shown, the projection 100 of the bottom surface 34 of the seat portion 28 is a substantially uniform square fence 100 extending integrally downward from the bottom surface 34 and disposed substantially concentric with the bottom surface 34. The fence 100 encloses the ring 90 and is inwardly spaced from the rim 88. The vertices 102 of the fence 100 intersect and are interleaved with respect to corresponding alternating ribs 96 other than those intersecting the vertices 98 of the enclosure 97. Each wall 104 of the fence 100 intersects and is interleaved with respect to a corresponding pair of adjacent segments 99 of the enclosure 97 and a rib 96 that bisects the corresponding pair, or, put another way, that intersects the respective vertex 98 of the enclosure 97. The fence 100 extends downward from the bottom surface 34 farther than does each of the ring 90, ribs, 96, and enclosure 97. Also, each wall 104 of the fence 100 is shorter than any segment 99 of the enclosure 97 such that each vertex 102 of the fence 100 is farther away from the rim 88 than is any vertex 98 of the enclosure 97. In this way, the seat portion 28 can be operatively supported in substantial alignment with respect to the base portion 26 such that the fence 100 abuts the rim 48 of the sunken portion 42.

The seat portion 28 also includes a plurality of bosses, generally indicated at 106, projecting integrally from and substantially perpendicular with respect to the bottom surface 34. The bosses 102 are located interior the fence 100. More specifically, four bosses are located adjacent corresponding corners of the fence 100 at corresponding intersections of ribs 96 with respective segments 99 of the enclosure 97. Each boss 106 defines a hole 108 disposed through the substantially longitudinal central axis of the boss 106. The holes 108 are adapted to be operatively aligned with the holes 84 of the base portion 26 to receive corresponding bolts or screws 86 for removably fastening the base and seat portions 26, 28, respectively, together.

The corresponding depths of the ring 90, each of the ribs 96, and the enclosure 97 are substantially equal with respect to one another. The corresponding depths of the fence 100 and each of the bosses 106 are substantially equal with respect to one another and generally greater than the depth of the ring 90, ribs 96, and enclosure 97. However, the depth of the portion of each segment 99 of the enclosure 97 located within the fence 100 is substantially equal to the depth of the fence 100 and bosses 106. Also, the depth of each portion of a rib 96 located between the fence 100 and corresponding boss 106 is substantially equal to the depth of the fence 100 and bosses 106.

The bottom edge of the ring 90 is adapted to operatively contact the shoulder 58 of the stem portion 50. Similarly, the ribs 96 and enclosure 97 are adapted to operatively contact the top surface 30 of the base portion 26, and the fence 100 is adapted to operatively contact the upper surface 44 of the sunken portion 42.

It will be appreciated by those having ordinary skill in the related art that the stool assembly 10, in general, and each of the various parts of the assembly 10, in particular, can have any suitable shape, size, and structure. It will also be appreciated that the various parts of the stool assembly 10 can have any suitable structural relationship with respect to each other and be made of any suitable material, such as ABS plastic. It will also be appreciated that the stool assembly 10, especially the seat portion 28, can be any suitable color.

In operation, an existing known one-piece stool seating portion can be removed and replaced with the stool assembly 10. In this instance and more specifically, the insert 68 is left in the stem portion 50 if the tubing 24 has a 1" diameter and removed from the stem portion 50 if the tubing 24 has a 1¼" diameter. The base portion 26, in general, and the stem portion 50, in particular, is then removably fastened to and about the tubing 24 using the old holes of the tubing 24 such that no drilling is required. The bottom surface 34 of the seat portion 28 is then removably supported to the top surface 30 of the base portion 26.

The seat portion of an existing known two-piece stool seating portion also can be removed and replaced with the stool assembly 10. In this instance, the seat portion of the existing known two-piece stool seating portion is removed from the plate, and the seat portion 28 of the stool assembly 10 and plate are securely retained with respect to each other. Alternatively, a base portion 26 and/or seat portion 28 of an existing stool assembly 10 can be replaced by a corresponding part or by corresponding parts of the assembly 10. In an institutionalized setting, instead of replacing any existing known one- and/or two-piece stool seating portion here and there on each of many tables 12, which may create non-uniformity among the stools, the stool assembly 10 can be used to replace each stool seating portion of each table 12, which creates uniformity among the assemblies 10.

The stool assembly 10 is an aftermarket table-stool seating portion providing a relatively efficient way of replacing a stool seating portion from a table 12. More specifically, the stool assembly 10 can require relatively less labor and materials and, thus, expense to replace the assembly 10, and replacement of any part of the assembly 10 does not necessarily require replacement of the entire assembly 10. For example, when either the base portion 26 or seat portion 28 is damaged, only the respective damaged base portion 26 or seat portion 28 must be replaced. In a like manner, when a change in color of the seat portion 28 is desired, only the seat portion 28 must be replaced. Similarly, when the diameter of the tubing 24 of the table 12 is 1", rather than 1¼" (or vice versa), only an insert 68 of the base portion 26 must be inserted (or removed). Also, the stool assembly 10 fits most tables 12 with 1" or 1¼" diameter tubing 24 and bolts into existing holes of the tubing 24 such that no re-drilling is required. Furthermore, the insert 68 can be designed having various sizes such that the stool assembly 10 can accommodate tubing 24 of various diameters. In addition, the stool assembly 10 can replace known one-piece or two-piece table-stool seating portions. Moreover, the stool assembly 10 is made of a relatively stronger ABS plastic.

The present invention has been described in an illustrative manner. It is to be understood that the terminology that has been used is intended to be in the nature of words of description rather than of limitation. Many modifications and variations of the present invention are possible in light of the above teachings. Therefore, within the scope of the appended claims, the present invention may be practiced other than as specifically described.

What is claimed is:

1. A replaceable stool assembly adapted to be removably mounted to a free end of a tubing of a piece of furniture, said assembly comprising:

a base portion including a top surface, adapted to be removably mounted to the free end of the tubing, and defining a plurality of reinforcing ribs disposed on said base portion for adding structural integrity to said base portion; and a seat portion including a top surface adapted to operatively support a user of said assembly and a bottom surface adapted to be nestingly received by and removably supported on said top surface of said base portion, wherein said bottom surface of said seat portion includes at least one projection and said top surface of said base portion includes at least one cavity adapted to nestingly receive corresponding said at least one projection such that said bottom surface of said seat portion is removably supported on said top surface of said base portion.

2. A replaceable stool assembly as set forth in claim 1, wherein said bottom surface of said seat portion includes at least one protrusion defining a substantially hollow interior and an opened end of said at least one protrusion and said top surface of said base portion defines at least one protrusion adapted to be matingly received through said opened end and within said hollow interior of corresponding said at least one protrusion of said seat portion such that said bottom surface of said seat portion is removably supported on said top surface of said base portion.

3. A replaceable stool assembly as set forth in claim 1, wherein said base portion includes a body portion having a bottom surface and said top surface of said base portion.

4. A replaceable stool assembly as set forth in claim 3, wherein said base portion includes a stem portion extending from said bottom surface of said body portion and defining a longitudinal passageway to define a substantially hollow interior and an opened end of said stern portion, the free end of the tubing adapted to be matingly received through said opened end and within said hollow interior of said stem portion to removably mount said base portion about the free end of the tubing.

5. A replaceable stool assembly as set forth in claim 4, wherein said plurality of reinforcing ribs are disposed on said bottom surface of said body portion and about said stem portion for adding structural integrity to said base portion.

6. A replaceable stool assembly as set forth in claim 1, wherein said base and seat portions are adapted to receive at least one fastener for removably fastening said base and seat portions together.

7. A replaceable stool assembly adapted to be removably mounted to a free end of a tubing of a piece of furniture, said assembly comprising:

a base portion including a top surface, adapted to be removably mounted to the free end of the tubing, and defining a plurality of reinforcing ribs disposed on said base portion for adding structural integrity to said base portion;

a seat portion including a top surface adapted to operatively support a user of said assembly and a bottom surface adapted to be nestingly received by and be removably supported on said top surface of said base portion; and an insert adapted to be removably mounted to said base portion and the free end of the tubing to, thereby, removably mount said base portion to the free end of the tubing, wherein said bottom surface of said seat portion includes at least one projection and said top surface of said base portion includes at least one cavity adapted to nestingly receive corresponding said at least one projection such that said bottom surface of said seat portion is removably supported on said top surface of said base portion.

8. A replaceable stool assembly as set forth in claim 7 wherein said bottom surface of said seat portion includes at least one protrusion defining a substantially hollow interior and an opened end of said at least one protrusion and said top surface of said base portion defines at least one protrusion adapted to be matingly received through said opened end and within said hollow interior of corresponding said at least one protrusion of said seat portion such that said bottom surface of said seat portion is removably supported on said top surface of said base portion.

9. A replaceable stool assembly as set forth in claim 7, wherein said insert defines a longitudinal passageway to define a hollow interior and an opened end of said insert, the free end of the tubing adapted to be matingly received through said opened end and within said hollow interior of said insert to removably mount said base portion to the free end of the tubing.

10. A replaceable stool assembly as set forth in claim 9, wherein said hollow interior of said insert defines an interior surface of said insert adapted to be in operative contact with the exterior surface of the free end of the tubing to create a slight, yet snug, interference fit between said insert and the free end of the tubing to removably mount said base portion to the free end of the tubing.

11. A replaceable stool assembly as set forth in claim 7, wherein said base portion includes a body portion having a bottom surface and said top surface of said base portion.

12. A replaceable stool assembly as set forth in claim 11, wherein said base portion includes a stem portion extending from said bottom surface of said body portion and defining a longitudinal passageway to define a substantially hollow interior and an opened end of said stern portion, said insert adapted to be matingly received through said opened end and within said hollow interior of said stem portion to removably mount said base portion to the free end of the tubing.

13. A replaceable stool assembly as set forth in claim 12, wherein said plurality of reinforcing ribs are disposed on said bottom surface of said body portion and about said stem portion for adding structural integrity to said base portion.

14. A replaceable stool assembly as set forth in claim 7, wherein said base and seat portions are adapted to receive at least one fastener for removably fastening said base and seat portions together.

15. A replaceable stool assembly adapted to be removably mounted to a free end of a tubing of a piece of furniture, said assembly comprising:

a base portion including a top surface, adapted to be removably mounted to the free end of the tubing, and defining a plurality of reinforcing ribs disposed on said base portion for adding structural integrity to said base portion;

a seat portion including a top surface adapted to operatively support a user of said assembly and a bottom surface adapted to be nestingly received by and removably supported on said top surface of said base portion; and an insert adapted to be removably mounted to said base portion and the free end of the tubing to, thereby, removably mount said base portion to the free end of the tubing, wherein said bottom surface of said seat portion includes at least one protrusion defining a substantially hollow interior and an opened end of said at least one protrusion and said top surface of said base portion defines at least one protrusion adapted to be matingly received through said opened end and within said hollow interior of corresponding said at least one protrusion of said seat portion such that said bottom surface of said seat portion is removably supported on said top surface of said base portion.

* * * * *